US009170540B2

(12) United States Patent
Hisatomi et al.

(10) Patent No.: US 9,170,540 B2
(45) Date of Patent: Oct. 27, 2015

(54) IMAGE FORMING APPARATUS AND METHOD TO DETERMINE AN OPERATION START TIME POINT OF A PHOTOCONDUCTOR DRIVING UNIT

(71) Applicant: Samsung Electronics Co., Ltd., Suwon-si (KR)

(72) Inventors: Shinichi Hisatomi, Suwon-si (KR); So-won Sheen, Seoul (KR); Jong-woo Lee, Seongnam-si (KR); Seok-hoon Choi, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/567,395

(22) Filed: Dec. 11, 2014

(65) Prior Publication Data

US 2015/0160597 A1 Jun. 11, 2015

(30) Foreign Application Priority Data

Dec. 11, 2013 (KR) ..... 10-2013-0154106

(51) Int. Cl.
*G03G 15/00* (2006.01)

(52) U.S. Cl.
CPC ..... *G03G 15/5008* (2013.01)

(58) Field of Classification Search
CPC ..... G03G 15/5008
USPC ..... 399/167
See application file for complete search history.

(56) References Cited

U.S. PATENT DOCUMENTS 8,244,157 B2 * 8/2012 Shirakata et al. ..... 399/167

FOREIGN PATENT DOCUMENTS

| | | |
|---|---|---|
| JP | 5-53419 | 3/1993 |
| JP | 7-334039 | 12/1995 |
| JP | 8-152834 | 6/1996 |
| JP | 11-78173 | 3/1999 |
| JP | 2000-211188 | 8/2000 |
| JP | 2000-330446 | 11/2000 |
| JP | 2005-178138 | 7/2005 |
| JP | 2006-260185 | 9/2006 |

* cited by examiner

*Primary Examiner* — William J Royer
(74) *Attorney, Agent, or Firm* — Staas & Halsey LLP

(57) ABSTRACT

An image forming apparatus and a method of controlling the image forming apparatus are provided. An image forming apparatus may determine the operation start time point of a photoconductor based on ready times of the photoconductor and devices used in image forming processes so as to minimize idling of the photoconductor.

19 Claims, 11 Drawing Sheets

FIG. 10

OPC Motor Ready Time[A] (ms)

| | NON-OPERATION TIME (S) | | INTERNAL TEMPERATURE INDEX (°C) | | | | | | | |
|---|---|---|---|---|---|---|---|---|---|---|
| | LCL | UCL | 0 - 4 | 5 - 9 | 10 - 14 | 15 - 19 | 20 - 24 | 25 - 29 | 30 - 34 | 35 - 45 |
| 1 | 0 | 1 | 198 | 166 | 150 | 142 | 138 | 136 | 134 | 132 |
| 2 | 1 | 2 | 204 | 168 | 152 | 144 | 140 | 136 | 134 | 132 |
| 3 | 2 | 3 | 206 | 170 | 152 | 144 | 140 | 138 | 136 | 134 |
| 4 | 3 | 5 | 210 | 172 | 154 | 144 | 140 | 138 | 136 | 134 |
| 5 | 5 | 8 | 212 | 174 | 154 | 144 | 140 | 138 | 136 | 134 |
| 6 | 8 | 12 | 216 | 176 | 156 | 146 | 140 | 138 | 136 | 134 |
| 7 | 12 | 20 | 218 | 176 | 156 | 146 | 140 | 138 | 136 | 134 |
| 8 | 20 | 30 | 222 | 178 | 156 | 146 | 140 | 138 | 136 | 134 |
| 9 | 30 | 60 | 226 | 180 | 158 | 146 | 142 | 138 | 136 | 134 |
| 10 | 60 | 150 | 232 | 184 | 160 | 148 | 142 | 138 | 136 | 134 |
| 11 | 150 | 360 | 238 | 186 | 162 | 148 | 142 | 138 | 136 | 134 |
| 12 | 360 | 900 | 244 | 190 | 162 | 150 | 142 | 140 | 138 | 136 |
| 13 | 900 | 65535 | 272 | 204 | 170 | 154 | 146 | 142 | 140 | 138 |

FIG. 11

LSU Motor Ready Time [C] (ms)

| | NON-OPERATION TIME (S) | | INTERNAL TEMPERATURE INDEX (°C) | | | | | | | |
|---|---|---|---|---|---|---|---|---|---|---|
| | LCL | UCL | 0 – 4 | 5 – 9 | 10 – 14 | 15 – 19 | 20 – 24 | 25 – 29 | 30 – 34 | 35 – 45 |
| 1 | 0 | 1 | 4500 | 4000 | 2711 | 2661 | 2611 | 2561 | 2511 | 2461 |
| 2 | 1 | 2 | 4500 | 4000 | 2928 | 2878 | 2828 | 2778 | 2728 | 2678 |
| 3 | 2 | 3 | 4500 | 4000 | 3054 | 3004 | 2954 | 2904 | 2854 | 2804 |
| 4 | 3 | 5 | 4500 | 4000 | 3214 | 3164 | 3114 | 3064 | 3014 | 2964 |
| 5 | 5 | 8 | 4500 | 4000 | 3361 | 3311 | 3261 | 3211 | 3161 | 3111 |
| 6 | 8 | 12 | 4500 | 4000 | 3488 | 3438 | 3388 | 3338 | 3288 | 3238 |
| 7 | 12 | 20 | 4500 | 4000 | 3600 | 3550 | 3500 | 3450 | 3400 | 3350 |
| 8 | 20 | 30 | 4500 | 4000 | 3600 | 3550 | 3500 | 3450 | 3400 | 3350 |
| 9 | 30 | 60 | 4500 | 4000 | 3600 | 3550 | 3500 | 3450 | 3400 | 3350 |
| 10 | 60 | 150 | 4500 | 4000 | 3600 | 3550 | 3500 | 3450 | 3400 | 3350 |
| 11 | 150 | 360 | 4500 | 4000 | 3600 | 3550 | 3500 | 3450 | 3400 | 3350 |
| 12 | 360 | 900 | 4500 | 4000 | 3600 | 3550 | 3500 | 3450 | 3400 | 3350 |
| 13 | 900 | 65535 | 4500 | 4000 | 3600 | 3550 | 3500 | 3450 | 3400 | 3350 |

FIG. 12 data ready time[D] (ms)

| | Scan Mode | | Ledger | A3 | B4 | Legal | LTR SEF | A4 SEF | B5 SEF | LTR LEF | A4 LEF | B5 LEF |
|---|---|---|---|---|---|---|---|---|---|---|---|---|
| | Mode | Quality | 432mm | 420mm | 364mm | 356mm | 279mm | 297mm | 257mm | 216mm | 210mm | 182mm |
| 1 | Color | Normal | 1000 | 972 | 842 | 823 | 644 | 685 | 592 | 497 | 483 | 418 |
| 2 | | Text | 500 | 486 | 421 | 411 | 321 | 341 | 294 | 246 | 239 | 206 |
| 3 | | Photo | 1300 | 1263 | 1094 | 1068 | 834 | 885 | 763 | 638 | 619 | 533 |
| 4 | | HD | 1500 | 1457 | 1262 | 1232 | 962 | 1020 | 879 | 734 | 712 | 613 |
| 6 | Mono | Normal | 600 | 582 | 504 | 492 | 384 | 407 | 350 | 292 | 283 | 243 |
| 7 | | Text | 250 | 242 | 209 | 204 | 159 | 168 | 144 | 120 | 116 | 99 |
| 8 | | Photo | 800 | 774 | 668 | 652 | 508 | 536 | 459 | 382 | 369 | 314 |
| 9 | | HD | 1000 | 967 | 834 | 814 | 634 | 668 | 572 | 476 | 459 | 390 |

ITB engage time [I] (ms)

| | | Speed[0] | Speed[1] | Speed[2] | |
|---|---|---|---|---|---|
| | | Normal | Half | 1/3 | cf.1200 dpi |
| 1 | engage | 323 | 323 | 323 | 323 |

Paper handling ready time [G] (ms)

| | | Speed[0] | Speed[1] | Speed[2] | |
|---|---|---|---|---|---|
| | Tray | Normal | Half | 1/3 | cf.1200 dpi |
| 1 | Tray-1 | 803 | 1506 | 2210 | 1506 |
| 2 | Tray-2 | 1095 | 2090 | 3085 | 2090 |
| 3 | Tray-3 | 1426 | 2753 | 4079 | 2753 |
| 4 | Tray-4 | 1671 | 3242 | 4813 | 3242 |
| 5 | Tray-MP | 683 | 1266 | 1850 | 1266 |
| 6 | Tray-LST | 1251 | 2403 | 3555 | 2403 |

IMAGE FORMING APPARATUS AND METHOD TO DETERMINE AN OPERATION START TIME POINT OF A PHOTOCONDUCTOR DRIVING UNIT

CROSS-REFERENCE TO RELATED APPLICATIONS

This application claims the priority benefit of Korean Patent Application No. 10-2013-0154106, filed on Dec. 11, 2013, in the Korean Intellectual Property Office, the disclosure of which is incorporated herein in its entirety by reference.

BACKGROUND

1. Field

One or more exemplary embodiments relate to an image forming apparatus and a method of controlling the image forming apparatus, and more particularly, to an electrophotographic image forming apparatus and a method of controlling the electrophotographic image forming apparatus.

2. Description of the Related Art

Electrophotographic image forming apparatuses are used to form images on printing media such as paper through image forming processes such as charging, exposing, developing, transferring, and fusing. For example, in an image forming unit of an image forming apparatus, charging, exposing, developing, and transferring are performed while rotating a photoconductor around which parts such as a charging roller, a developing roller, and a transfer roller are disposed at predetermined positions, so as to form a toner image on a printing medium, and then the toner image is heated and pressed to fuse the toner image on the printing medium. The photoconductor is rotated at a constant speed during such image forming processes.

A ready time is necessary for the photoconductor to rotate at a constant speed, and the photoconductor may idle if not used in image forming processes after the photoconductor rotates at a constant speed.

SUMMARY

One or more exemplary embodiments include an image forming apparatus capable of optimally forming images by minimizing idling of a photoconductor, and a method of controlling the image forming apparatus.

In an aspect of one or more embodiments, there is provided an electrophotographic image forming apparatus which includes: a storage storing a ready time of at least one device used in an image forming process; a control unit determining an operation start time point of a photoconductor driving unit based on the ready time of the at least one device stored in the storage and a ready time of the photoconductor driving unit predicted to be necessary to enter a constant-speed rotation state; and an image forming unit configured to form an image by operating the photoconductor driving unit at the determined operation start time point.

In an aspect of one or more embodiments, there is provided a method of controlling an electrophotographic image forming apparatus which includes: checking a ready time of at least one device used in an image forming process; determining an operation start time point of a photoconductor driving unit based on the ready time of the at least one device and a ready time of the photoconductor driving unit predicted to be necessary to enter a constant-speed rotation state; and operating the photoconductor driving unit at the determined operation start time point.

In an aspect of one or more embodiments, there is provided at least one non-transitory computer readable medium storing computer readable instructions which when executed implement methods of one or more embodiments

BRIEF DESCRIPTION OF THE DRAWINGS

These and/or other aspects will become apparent and more readily appreciated from the following description of embodiments, taken in conjunction with the accompanying drawings in which:

FIG. 10 is a view illustrating ready times of a photoconductor driving unit stored in a storage in the image forming apparatus according to an exemplary embodiment;

FIG. 11 is a view illustrating ready times of a polygonal mirror driving unit of a light scanning unit stored in the storage in the image forming apparatus according to an exemplary embodiment;

FIG. 12 is a view illustrating ready times of a data conversion unit stored in the storage in the image forming apparatus according to an exemplary embodiment;

DETAILED DESCRIPTION

Figure 1:
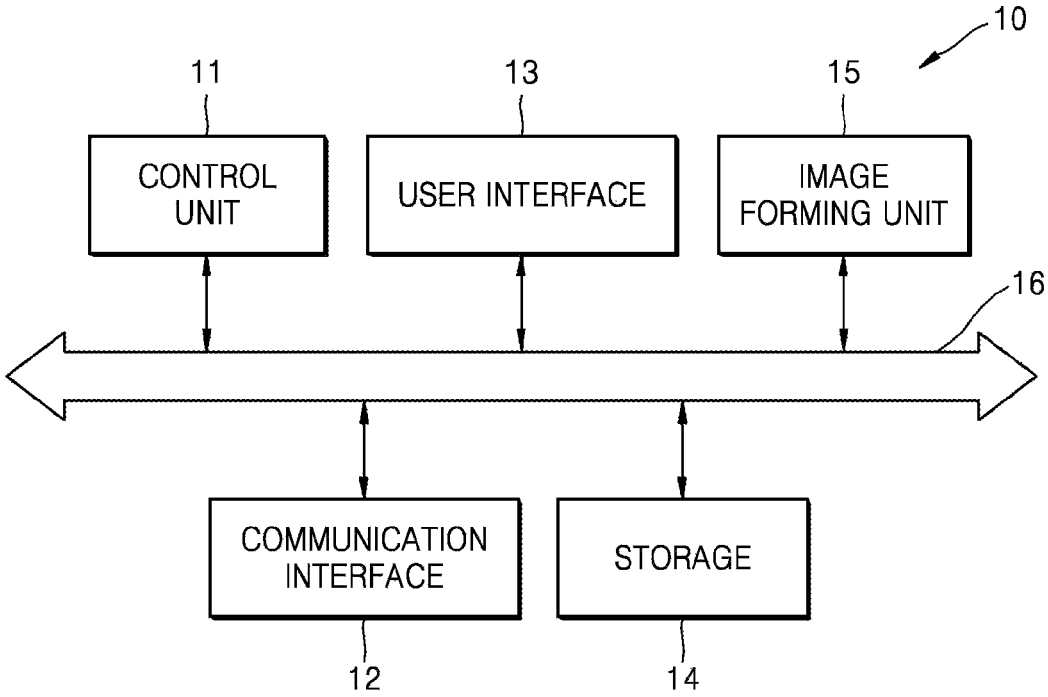
FIG. 1 is a view illustrating the structure of an image forming apparatus according to an exemplary embodiment.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

In the following descriptions of embodiments, expressions or terms such as "constituted by," "formed by," "include," "comprise," "including," and "comprising" should not be construed as always including all specified elements, processes, or operations, but may be construed as not including some of the specified elements, processes, or operations, or further including other elements, processes, or operations.

In addition, although the terms "first and second" are used to describe various elements, these elements should not be limited by these terms. These terms are only used to distinguish one element from another element.

In exemplary embodiments of an image forming apparatus and a method of controlling the image forming apparatus, those well-known features to a person of ordinary skill in the art will not be described in detail.

FIG. 1 is a view illustrating the structure of an image forming apparatus 10 according to an exemplary embodiment.

Referring to FIG. 1, the image forming apparatus 10 may include a control unit 11, a communication interface 12, a user interface 13, a storage 14, and an image forming unit 15. The elements of the image forming apparatus 10 may transmit data to each other through a data bus 16. Those of ordinary skill in the art to which an embodiment of the disclosure pertains may easily understand that the image forming apparatus 10 may further include other general-use elements. For example, the image forming apparatus 10 may further include a facsimile unit converting image data of a document into facsimile data or processing facsimile data received from an external device, or a scanning unit capable of producing scan data by scanning image data of a document.

The control unit 11 may control overall operations of the image forming apparatus 10. The control unit 11 may be a microprocessor. For example, the control unit 11 may include a plurality of processor modules separated from each other according to functions thereof, and a main processor module integrally managing the processor modules. The control unit 11 may receive data from an external device through the communication interface 12 or transmit data to an external device through the communication interface 12. The control unit 11 may process information input by a user through the user interface 13 and may output processed results through the user interface 13. For this, the control unit 11 may form a user interface screen. The control unit 11 may store various programs and data in the storage 14 and read the programs and data from the storage 14. The control unit 11 may carry out calculations using data read from the storage 14 or may compare data read from the storage 14. Data stored in the storage 14 may be transmitted to the image forming unit 15 under the control of the control unit 11.

The communication interface 12 may include a network module for connection with networks according to applications and functions of the image forming apparatus 10, a modem for sending and receiving facsimiles, and a universal serial bus (USB) host module to form a data channel for portable storage media. Examples of external devices that may be connected to the image forming apparatus 10 through wired or wireless networks may include servers, personal computers (PCs) such as laptop computers and desktop computers, mobile devices such as smartphones, personal digital assistants, and facsimile machines.

The user interface 13 may display information for users and receive signals input by users. Examples of the user interface 13 of the image forming apparatus 10 include input/output devices such as capacitive or piezoelectric touch screens, display panels, touch pads, keyboards, mice, and speakers. The user interface 13 may receive various data relating to operations of the image forming apparatus 10 from users.

The storage 14 may store data generated according to operations of the image forming apparatus 10 or necessary for operations of the image forming apparatus 10. For example, the storage 14 may store various programs and data used for controlling the image forming apparatus 10 and data generated or received according to operations of the image forming apparatus 10 such as data received from external devices, data input through the user interface 13, facsimile data, scan data, and printing data.

The image forming unit 15 may be used to form images. That is, the image forming unit 15 may be used to output copy or printing data on printing media such as paper. For outputting copy and printing data on printing media, the image forming unit 15 may include hardware units for charging, exposing, developing, transferring, and fusing, and software modules for operating the hardware units. Exemplary configurations or structures and operations of the image forming unit 15 will now be described in detail with reference to FIGS. 2 and 3.

Figure 2:
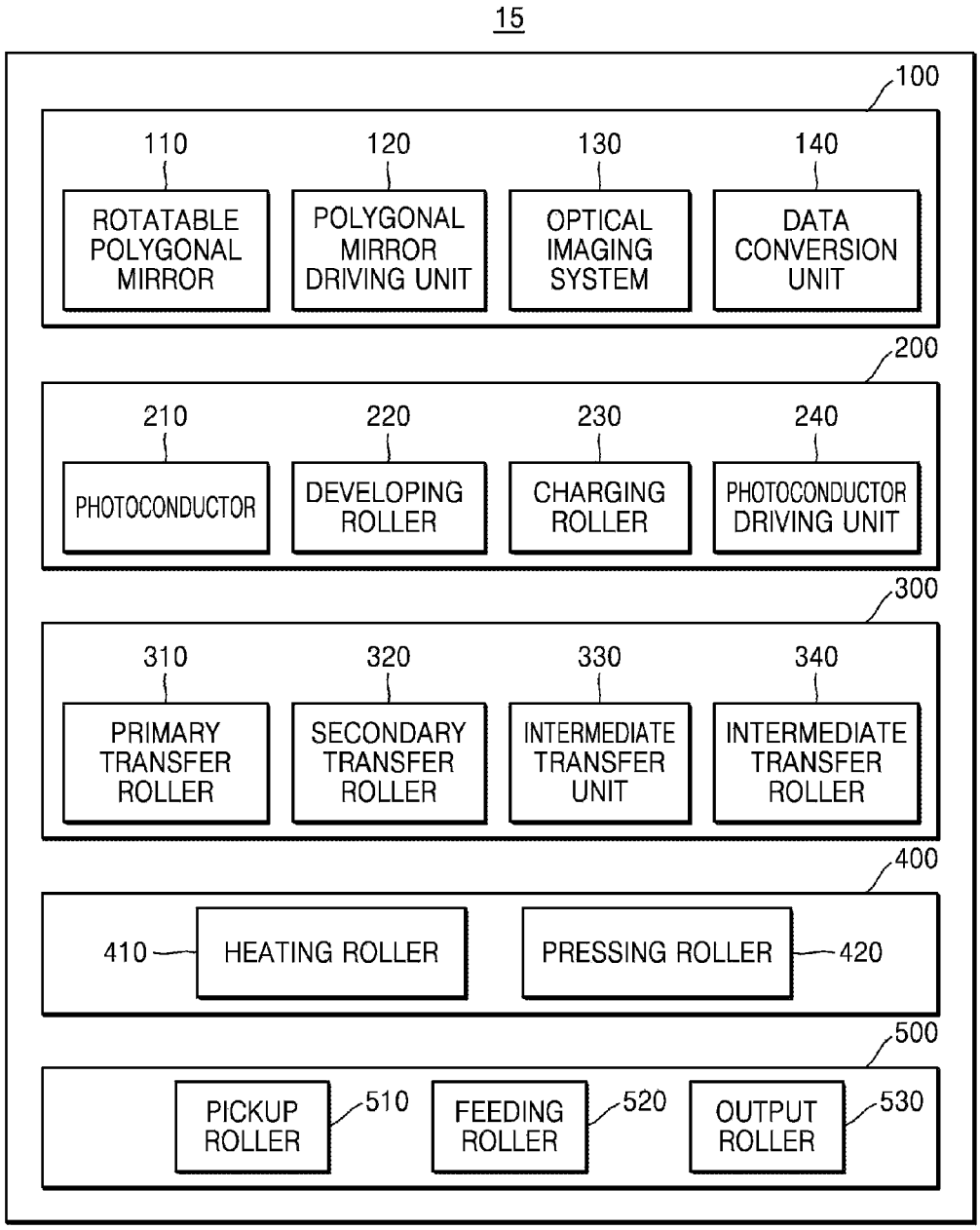
FIG. 2 is a block diagram illustrating an image forming unit of the image forming apparatus according to an exemplary embodiment.

FIG. 2 is a block diagram illustrating the image forming unit 15 of the image forming apparatus 10 according to an exemplary embodiment.

Referring to FIG. 2, the image forming unit 15 may include a light scanning unit 100, a developing unit 200, a transfer unit 300, a fusing unit 400, and a paper feeding unit 500. The light scanning unit 100 may include a rotatable polygonal mirror 110, a polygonal mirror driving unit 120, an optical imaging system 130, and a data conversion unit 140. The developing unit 200 may include a photoconductor 210, a developing roller 220, a charging roller 230, and a photoconductor driving unit 240. The transfer unit 300 may include a primary transfer roller 310, a secondary transfer roller 320, an intermediate transfer unit 330, and an intermediate transfer roller 340. The fusing unit 400 may include a heating roller 410 and a pressing roller 420. The paper feeding unit 500 may include a pickup roller 510, a feeding roller 520, and an output roller 530. Those of ordinary skill in the art to which an embodiment of the disclosure pertains may easily understand that the image forming unit 15 may further include other general-use elements.

In the light scanning unit 100, the rotatable polygonal mirror 110 may deflect light incident from a light source, and the optical imaging system 130 may transmit the light deflected from the rotatable polygonal mirror 110 to the photoconductor 210 for forming an image. The polygonal mirror driving unit 120 may be a polygonal mirror driving motor configured to rotate the rotatable polygonal mirror 110. The data conversion unit 140 may convert image data into exposure data available to the light scanning unit 100. The data conversion unit 140 may be disposed in the light scanning unit 100 or may be disposed outside of the light scanning unit 100 and connected to the light scanning unit 100.

In the developing unit 200, the photoconductor 210 may form an electrostatic latent image or may form a toner image from the electrostatic latent image by using a developer such as toner. The photoconductor 210 may be a photoconductive drum. The developing roller 220 may supply a developer such as toner to the surface of the photoconductor 210 on which an electrostatic latent image is formed. The charging roller 230 may charge the surface of the photoconductor 210 to a uniform potential before the photoconductor 210 is exposed to light by the light scanning unit 100. During an image forming process, the photoconductor driving unit 240 may rotate the photoconductor 210 and maintain the photoconductor 210 at a constant-speed rotation state. The photoconductor driving unit 240 may be a photoconductor driving motor.

The primary transfer roller 310 of the transfer unit 300 may form a primary transfer region together with the photoconductor 210 and the intermediate transfer unit 330, and may transfer a toner image from the surface of the photoconductor 210 to the intermediate transfer unit 330. The secondary transfer roller 320 may form a secondary transfer unit together with the intermediate transfer unit 330 and may transfer a toner image from the intermediate transfer unit 330 to a printing medium. The intermediate transfer unit 330 may be an intermediate transfer belt. The intermediate transfer roller 340 may rotate the intermediate transfer belt.

In the fusing unit 400, the heating roller 410 may fuse a toner image on a printing medium by heating the toner image after the toner image is transferred to the printing medium, and the pressing roller 420 may press the toner image while the heating roller 410 heats the toner image for securely fusing the toner image on the printing medium.

In the paper feeding unit 500, the pickup roller 510 may receive a printing medium such as paper from a paper supply unit such as a tray, and the feeding roller 520 may feed the paper to a position at which a toner image will be transferred to the paper. The output roller 530 may output paper from the image forming apparatus 10 after the fusing unit 400 performs a fusing process on the paper. Exemplary structures and operations of the image forming unit 15 will now be described in detail with reference to FIG. 3.

Figure 3:
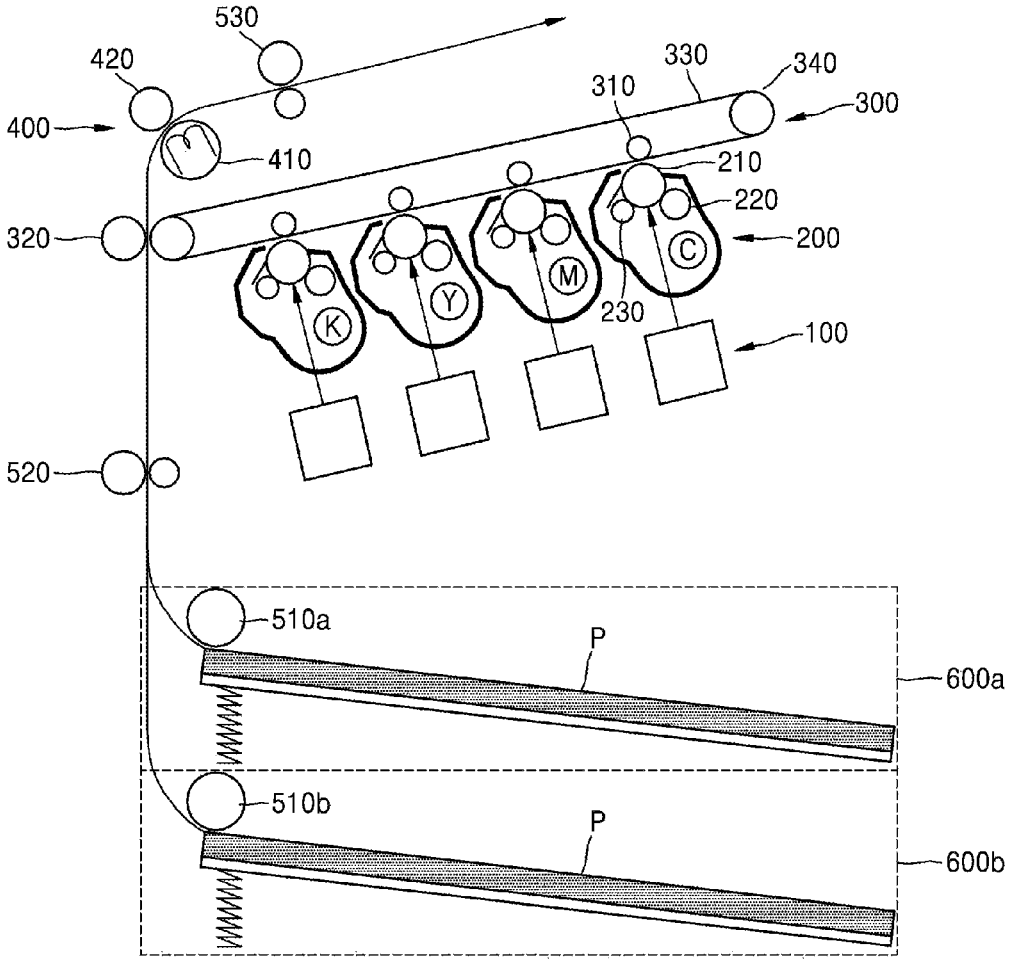
FIG. 3 is a view for illustrating exemplary structures and operations of the image forming unit of the image forming apparatus according to an exemplary embodiment.

FIG. 3 is a view for illustrating exemplary structures and operations of the image forming unit 15 of the image forming apparatus 10 according to an exemplary embodiment. Referring to FIG. 3, in the current embodiment of the disclosure, the image forming apparatus 10 is an electrophotographic image forming apparatus including light scanning units 100 and capable of forming color images using a developer such as toner.

The image forming apparatus 10 of the current embodiment may include the light scanning units 100, developing units 200, a transfer unit 300, and a fusing unit 400. The image forming apparatus 10 may receive paper (P) from a first tray 600*a* or a second tray 600*b* and may form an image on the paper (P) fed through a paper feeding passage.

For printing a color image, the light scanning units 100 may emit a plurality of light beams to photoconductors 210 of the developing units 200. The developing units 200 including the photoconductors 210 may be color developing units respectively corresponding to a plurality of light beams emitted from the light scanning units 100. For example, the light scanning units 100 may emit four light beams corresponding to black (K), magenta (M), yellow (Y), and cyan (C).

The developing units 200 may respectively include developing rollers 220 to develop electrostatic latent images formed on the photoconductors 210 such as photoconductive drums (image receptors). The developing units 200 may be a black (K) developing unit, a magenta (M) developing unit, a yellow (Y) developing unit, and a cyan (C) developing unit.

For example, the photoconductors 210 may be photoconductive drums each including a cylindrical metal pipe and a photoconductive layer formed on the cylindrical metal pipe to a predetermined thickness. The outer surfaces of the photoconductive drums may be exposed to light beams. The photoconductors 210 may be exposed to the outsides of the developing units 200 and arranged at predetermined intervals in a sub-scanning direction. Instead of photoconductive drums, photoconductive belts may be used as the photoconductors 210.

Charging rollers 230 may be disposed at upstream sides of the outer surfaces of the photoconductive drums to be exposed to light beams emitted from the light scanning units 100. The charging rollers 230 may be rotated while making contact with the photoconductors 210 (photoconductive drums) so as to charge the surfaces of the photoconductors 210 to a uniform potential. The charging rollers 230 are a kind of charger. A charging bias voltage may be applied to the charging rollers 230. Corona chargers (not shown) may be used instead of the charging rollers 230. Toner applied to the developing rollers 220 may be supplied to the photoconductive 210. A developing bias voltage may be applied to the developing rollers 220 for supplying toner from the developing rollers 220 to the photoconductors 210. Although not shown in FIG. 3, photoconductor driving units 240 (refer to FIG. 2) may be connected to the photoconductors 210 of the developing units 200 to drive the photoconductors 210.

An intermediate transfer unit 330 may face the outer surfaces of the photoconductors 210. As shown in FIG. 3, the intermediate transfer unit 330 may be an intermediate transfer belt. Instead of the intermediate transfer belt, an intermediate transfer drum may be used as the intermediate transfer unit 330 to transfer toner images from the photoconductors 210 to paper (P). The intermediate transfer unit 330 may be rotated while making contact with the photoconductors 210. As shown in FIG. 3, four primary transfer rollers 310 may be disposed at positions respectively facing the photoconductors 210 with the intermediate transfer unit 330 being disposed therebetween. A first transfer bias voltage may be applied to the primary transfer rollers 310 for transferring toner images from the photoconductors 210 to the intermediate transfer unit 330.

A secondary transfer roller 320 may be disposed at a position facing the intermediate transfer unit 330, and paper (P) may pass between the secondary transfer roller 320 and the intermediate transfer unit 330. A second bias voltage may be applied to the secondary transfer roller 320 for transferring toner images from the intermediate transfer unit 330 to paper (P).

Hereinafter, image forming processes using the above-described structures will be described.

The photoconductors 210 of the developing units 200 are charged to a uniform potential by a charging bias voltage applied to the charging rollers 230.

The light scanning units 100 emits light to the surfaces of the photoconductors 210 in the length direction (main scanning direction) of the photoconductors 210. At this time, the photoconductors 210 are rotated, and thus the surfaces of the photoconductors 210 are moved in a sub-scanning direction. In this way, two-dimensional electrostatic latent images corresponding to black (K), magenta (M), yellow (Y), and cyan (C) image data are formed on the surfaces of the (four) photoconductors 210, respectively. The sub-scanning direction may be perpendicular to the main scanning direction. The four developing units 200 supply black (K), magenta (M), yellow (Y), and cyan (C) toner to the photoconductors 210, respectively, so as to form black (K), magenta (M), yellow (Y), and cyan (C) toner images on the photoconductors 210.

The black (K), magenta (M), yellow (Y), and cyan (C) toner images are transferred from the photoconductors 210 to the intermediate transfer unit 330 in a superimposed manner by a first transfer bias voltage applied to the primary transfer rollers 310. In this way, a color toner image is formed on the intermediate transfer unit 330.

A printing medium such as paper (P) to which the color toner image will be finally transferred is fed between the intermediate transfer unit 330 and the secondary transfer roller 320 by a pickup roller 510*a* or 510*b* and feeding rollers 520. The color toner image is transferred from the intermediate transfer unit 330 to the paper (P) by a second transfer bias voltage applied to the secondary transfer roller 320. The color toner image transferred to the paper (P) is retained on the surface of the paper (P) by an electrostatic force. The paper (P) on which the color toner image is transferred is fed to the fusing unit 400. The color toner image transferred to the paper (P) receives heat and pressure from a heating roller 410 and a pressing roller 420 of the fusing unit 400, and is thus fused on the paper (P). After the color toner image is fused on the paper (P), the paper (P) is discharged to the outside of the light scanning units 100 by output rollers 530.

In the above-described image forming processes, the photoconductors 210 such as photoconductive drums are rotated at a constant speed for forming electrostatic latent images and toner images thereon. For this, the photoconductor driving units 240 such as photoconductor driving motors are connected to the photoconductors 210. As the photoconductor driving units 240 operate, the photoconductors 210 start to rotate, and after a predetermined ready time, the photoconductors 210 enter a constant-speed rotation state for image forming processes. In other words, according to the operation start time points of the photoconductor driving units 240, image forming processes may be delayed, or the photoconductors 210 may unnecessarily idle.

In the image forming apparatus 10 of the current embodiment, optimal operation start time points of the photoconductor driving units 240 may be determined based on a ready time of at least one device used in image forming processes and ready times of the photoconductor driving units 240 predicted to be necessary to rotate at a constant speed. At this time, the ready time of the at least one device used in image forming processes may be stored in the storage 14 of the image forming apparatus 10. Examples of determining the operation start time points of the photoconductor driving units 240 of the image forming apparatus 10 will now be described according to embodiments of the disclosure.

Figure 4:
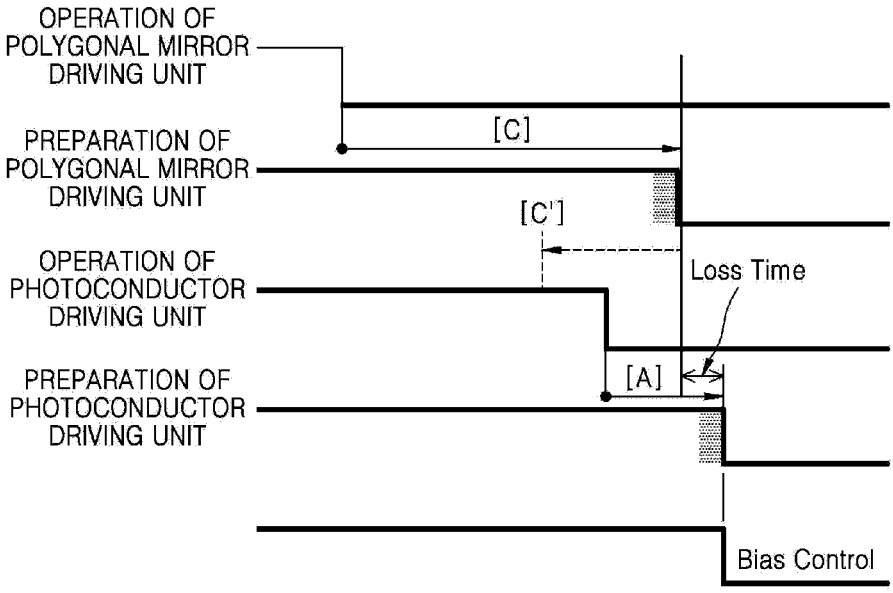
FIG. 4 is a view for explaining a process of determining an operation start time point of a photoconductor driving unit based on a ready time of a polygonal mirror driving unit of a light scanning unit and a ready time of the photoconductor driving unit, in the image forming apparatus according to an exemplary embodiment.

FIG. 4 is a view for explaining a process of determining an operation start time point of a photoconductor driving unit 240 based on a ready time of a polygonal mirror driving unit 120 of a light scanning unit 100 and a ready time of the photoconductor driving unit 240, in the image forming apparatus 10 according to an exemplary embodiment.

Referring to FIG. 4, first to fifth signal tables indicating starts or completion of processes are shown. From the top, the first signal table shows an operation start time point of the polygonal mirror driving unit 120 of the light scanning unit 100, the second signal table shows a time point at which the polygonal mirror driving unit 120 of the light scanning unit 100 enters a constant-speed rotation state, the third signal table shows an operation start time point of the photoconductor driving unit 240, the fourth signal table shows a time point at which the photoconductor driving unit 240 enters a constant-speed rotation state, and the fifth signal table shows a start time point of bias control for adjusting a surface potential of a photoconductor 210.

A time period from a signal generation time point of the first signal table to a signal generation time point of the second signal table is a ready time [C] of the polygonal mirror driving unit 120 predicted to be necessary to enter a constant-speed rotation state for rotating a rotatable polygonal mirror 110 deflecting light incident from a light source. The ready time [C] of the polygonal mirror driving unit 120 may be included in a ready time of the light scanning unit 100 predicted to be necessary to prepare emitting light.

A time period from a signal generation time point of the third signal table to a signal generation time point of the fourth signal table is a ready time [A] of the photoconductor driving unit 240 predicted to be necessary to enter a constant-speed rotation state.

A signal generation time point of the fifth signal table is a start time point of bias control for adjusting the surface potential of the photoconductor 210. The bias control for adjusting the surface potential of the photoconductor 210 is possible after the photoconductor driving unit 240 enters a constant-speed rotation state, and thus may start at the same time point as the signal generation time point of the fourth signal table.

Referring to the second and fourth signal tables of FIG. 4, since the time point at which the polygonal mirror driving unit 120 enters a constant-speed rotation state is different from the time point at which the photoconductor driving unit 240 enters a constant-speed rotation state, there is a loss time. Therefore, if the time point at which the polygonal mirror driving unit 120 enters a constant-speed rotation state is equal to the time point at which the photoconductor driving unit 240 enters a constant-speed rotation state, line scanning of the light scanning unit 100 which starts just after the ready time of the polygonal mirror driving unit 120, and bias control which starts just after the ready time of the photoconductor driving unit 240 may be performed without any loss time. In other words, the condition that the ready times of the polygonal mirror driving unit 120 and the photoconductor driving unit 240 are over at the same time point is an optimal condition for preventing a delay or unnecessary idling of the photoconductor 210.

To satisfy the optical condition, the control unit 11 of the image forming apparatus 10 may determine the operation start time point of the photoconductor driving unit 240 by inversely calculating the ready time of the photoconductor driving unit 240 from the ready time of the light scanning unit 100 predicted to be necessary to prepare emitting light. If the ready time of the light scanning unit 100 is almost equal to the ready time of the polygonal mirror driving unit 120, as shown in FIG. 4, an operation start time point [C'] (hereinafter referred to as a first operation start time point [C']) of the photoconductor driving unit 240 may be calculated using the ready time [C] of the polygonal mirror driving unit 120 and the ready time [A] of the photoconductor driving unit 240 as expressed by Equation 1 below:

$$[C']=[C]-[A] \quad \text{[Equation 1]}$$

The ready time [A] of the photoconductor driving unit 240 may be predicted based on a time period during which the photoconductor driving unit 240 is left without rotation and the internal temperature of the image forming apparatus 10, and may previously be stored in the storage 14 of the image forming apparatus 10. In addition, the ready time of the light scanning unit 100 or the ready time [C] of the polygonal mirror driving unit 120 may be predicted based on a time period during which the light scanning unit 100 is left without light emission and the internal temperature of the image forming apparatus 10, and may previously be stored in the storage 14 of the image forming apparatus 10.

If the photoconductor driving unit 240 starts to operate at the first operation start time point [C'] in consideration of the operation of the polygonal mirror driving unit 120, a delay or unnecessary idling of the photoconductor 210 may be minimized during image forming processes.

Figure 5:
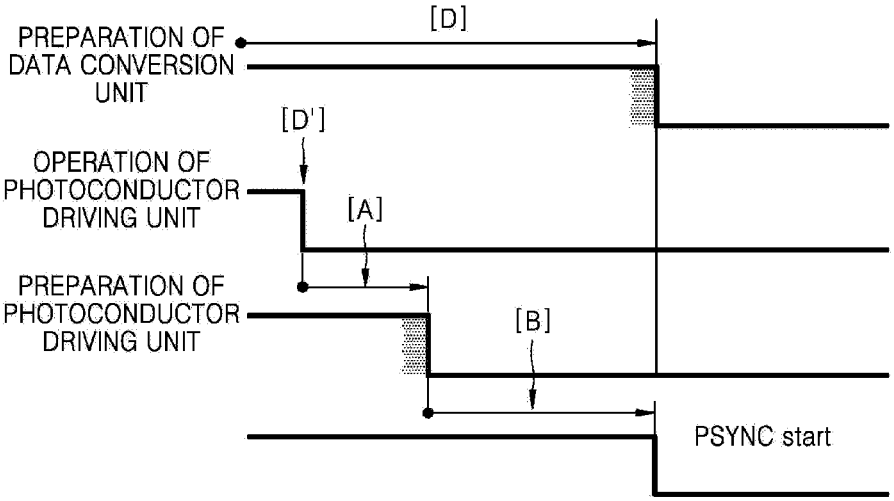
FIG. 5 is a view for explaining a process of determining an operation start time point of a photoconductor driving unit based on a ready time of a data conversion unit and a ready time of the photoconductor driving unit, in the image forming apparatus according to an exemplary embodiment.

FIG. 5 is a view for explaining a process of determining an operation start time point of a photoconductor driving unit 240 based on a ready time of a data conversion unit 140 and a ready time of the photoconductor driving unit 240, in the image forming apparatus 10 according to an exemplary embodiment.

Referring to FIG. 5, first to fourth signal tables indicating starts or completion of processes are shown. From the top, the first signal table shows a time point at which the data conversion unit 140 finishes conversion of image data, the second signal table shows an operation start time point of the photoconductor driving unit 240, the third signal table shows a time point at which the photoconductor driving unit 240 enters a constant-speed rotation state, and the fourth signal table shows a time point after the photoconductor driving unit 240 enters a constant-speed rotation state, a ready time for preparing an electrostatic latent image is terminated, and a time period necessary for the data conversion unit 140 to convert all image data is terminated.

In the first signal table, a time period predicted for the data conversion unit 140 to convert all image data is a ready time [D] of the data conversion unit 140.

A time period from a signal generation time point of the second signal table to a signal generation time point of the third signal table is a ready time [A] of the photoconductor driving unit 240 predicted to be necessary to enter a constant-speed rotation state.

A time period from a signal generation time point of the third signal table to a signal generation time point of the fourth signal table is a ready time [B] necessary to prepare forming of an electrostatic latent image after the photoconductor driving unit 240 enters a constant-speed rotation state. A signal generation time point of the fourth signal table is a time point at which a synchronizing signal PSYNC is generated after the data conversion unit 140 converts image data into exposure data.

As the amount or complexity of image data increases, the ready time [D] of the data conversion unit 140 increases, and if the photoconductor driving unit 240 enters a constant-speed rotation state within the ready time [D] of the data conversion unit 140 and the ready time [B] necessary to prepare forming of an electrostatic latent image is terminated within the ready time [D] of the data conversion unit 140, a photoconductor 210 may wear down. Therefore, an optimal condition may be that the ready time [D] of the data conversion unit 140 is terminated together with the ready time [B] necessary to prepare forming of an electrostatic latent image after the ready time [A] of the photoconductor driving unit 240 predicted to be necessary to enter a constant-speed rotation state. If the optimal condition is satisfied, a delay or unnecessary idling of the photoconductor 210 may be prevented during image forming processes.

To satisfy the optimal condition, the control unit 11 of the image forming apparatus 10 may determine an operation start time point of the photoconductor driving unit 240 by inversely calculating the ready time [B] necessary to prepare forming of an electrostatic latent image after the photoconductor driving unit 240 enters a constant-speed rotation state, and the ready time [A] of the photoconductor driving unit 240, from the ready time [D] of the data conversion unit 140 predicted to be necessary to finish conversion of all image data.

As shown in FIG. 5, an operation start time point [D'] (hereinafter referred to as a second operation start time point [D']) of the photoconductor driving unit 240 may be expressed by Equation 2 based on the ready time [D] of the data conversion unit 140, the ready time [A] of the photoconductor driving unit 240, and the ready time [B] necessary to prepare forming of an electrostatic latent image after the photoconductor driving unit 240 enters a constant-speed rotation state.

$$[D']=[D]-[A]-[B] \quad \text{[Equation 2]}$$

The ready time [A] of the data conversion unit 140 may be predicted based on a paper size, an image type, and an image quality level, and may previously be stored in the storage 14 of the image forming apparatus 10. The ready time [A] of the photoconductor driving unit 240 may be predicted based on a time period during which the photoconductor driving unit 240 is left without rotation and the internal temperature of the image forming apparatus 10, and may previously be stored in the storage 14 of the image forming apparatus 10. In addition, the ready time [B] necessary to prepare forming of an electrostatic latent image after the photoconductor driving unit 240 enters a constant-speed rotation state may previously be stored in the storage 14.

If the photoconductor driving unit 240 starts to operate at the second operation start time point [D'] in consideration of the operation of the data conversion unit 140, a delay or unnecessary idling of the photoconductor 210 may be minimized during image forming processes.

Figure 6:
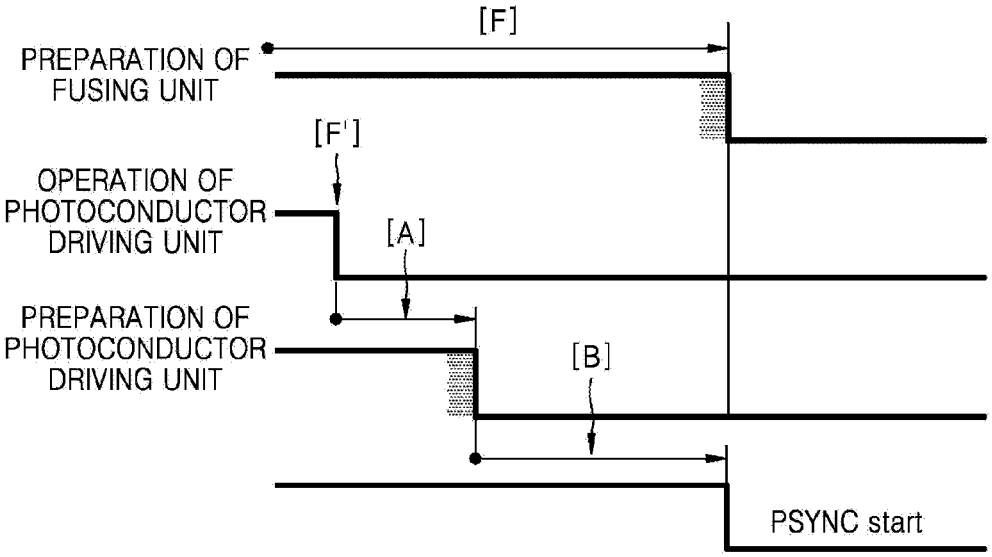
FIG. 6 is a view for explaining a process of determining an operation start time point of a photoconductor driving unit based on a ready time of a fusing unit and a ready time of the photoconductor driving unit, in the image forming apparatus according to an exemplary embodiment.

FIG. 6 is a view for explaining a process of determining an operation time point of a photoconductor driving unit 240 based on a ready time of the fusing unit 400 and a ready time of the photoconductor driving unit 240, in the image forming apparatus 10 according to an exemplary embodiment.

Referring to FIG. 6, first to fourth signal tables indicating starts or completion of processes are shown. From the top, the first signal table shows a time point at which the fusing unit 400 is ready to fuse a toner image transferred to paper, the second signal table shows an operation start time point of the photoconductor driving unit 240, the third signal table shows a time point at which the photoconductor driving unit 240 enters a constant-speed rotation state, and the fourth signal table shows a time point after the photoconductor driving unit 240 enters a constant-speed rotation state, a ready time for preparing an electrostatic latent image is terminated, and the fusing unit 400 is ready to fuse a toner image transferred to paper.

In the first signal table, a time period during which the fusing unit 400 is predicted to be read to fuse a toner image transferred to paper is a ready time [F] of the fusing unit 400.

A time period from a signal generation time point of the second signal table to a signal generation time point of the third signal table is a ready time [A] of the photoconductor driving unit 240 predicted to be necessary to enter a constant-speed rotation state.

A time period from a signal generation time point of the third signal table to a signal generation time point of the fourth signal table is a ready time [B] necessary to prepare forming of an electrostatic latent image after the photoconductor driving unit 240 enters a constant-speed rotation state. A signal generation time point of the fourth signal table is a time point at which a synchronizing signal PSYNC is generated when the fusing unit 400 is ready to fuse a toner image transferred to paper.

If the photoconductor driving unit 240 enters a constant-speed rotation state and the ready time [B] necessary to prepare forming of an electrostatic latent image is terminated within the ready time [F] of the fusing unit 400 predicted to be necessary to enter a state capable of fusing a toner image transferred to paper from a low power mode or sleep mode, a photoconductor 210 may be wear down. Therefore, an optimal condition may be that the ready time [F] of the fusing unit 400 is terminated together with the ready time [B] necessary to prepare forming of an electrostatic latent image after the ready time [A] of the photoconductor driving unit 240 predicted to be necessary to enter a constant-speed rotation state. If the optimal condition is satisfied, a delay or unnecessary idling of the photoconductor 210 may be prevented during image forming processes.

To satisfy the optimal condition, the control unit 11 of the image forming apparatus 10 may determine an operation start time point of the photoconductor driving unit 240 by inversely calculating the ready time [B] necessary to prepare forming of an electrostatic latent image after the photoconductor driving unit 240 enters a constant-speed rotation state and the ready time [A] of the photoconductor driving unit 240, from the ready time [F] of the fusing unit 400 predicted to be necessary to enter a state capable of fusing a toner image transferred to paper.

As shown in FIG. 6, an operation start time point [F'] (hereinafter referred to as a third operation start time point [F']) of the photoconductor driving unit 240 may be expressed by Equation 3 based on the ready time [F] of the fusing unit 400, the ready time [A] of the photoconductor driving unit 240, and the ready time [B] necessary to prepare forming of an electrostatic latent image after the photoconductor driving unit 240 enters a constant-speed rotation state.

$$[F']=[F]-[A]-[B] \quad \text{[Equation 3]}$$

The ready time [F] of the fusing unit 400 may be predicted based on a time period during which the fusing unit 400 is left in low power mode or sleep mode and the internal temperature of the image forming apparatus 10, and may previously be stored in the storage 14 of the image forming apparatus 10. The ready time [A] of the photoconductor driving unit 240 may be predicted based on a time period during which the photoconductor driving unit 240 is left without rotation and the internal temperature of the image forming apparatus 10, and may previously be stored in the storage 14 of the image forming apparatus 10. In addition, the ready time [B] necessary to prepare forming of an electrostatic latent image after the photoconductor driving unit 240 enters a constant-speed rotation state may previously be stored in the storage 14.

If the photoconductor driving unit 240 starts to operate at the third operation start time point [D'] in consideration of the operation of the fusing unit 400, a delay or unnecessary idling of the photoconductor 210 may be minimized during image forming processes.

Figure 7:
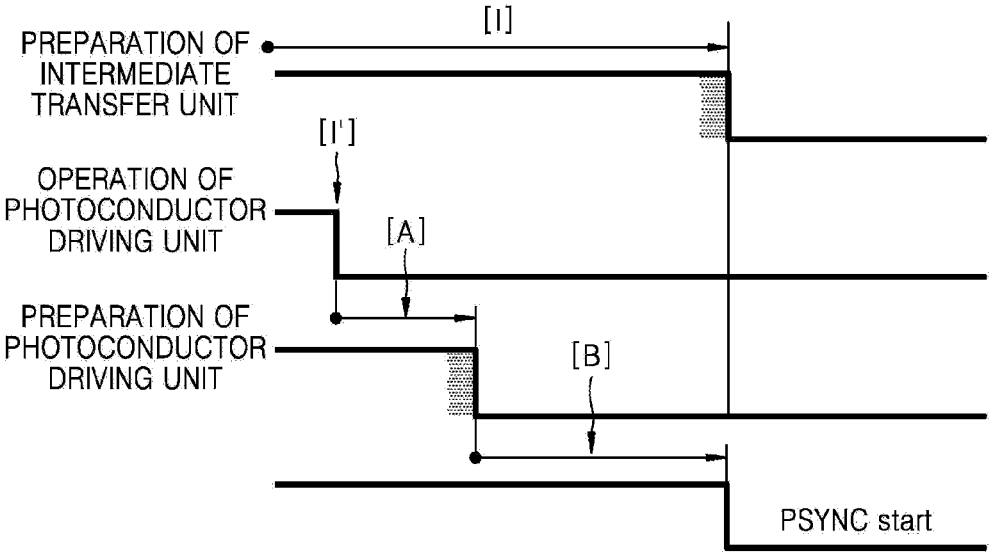
FIG. 7 is a view for explaining a process of determining an operation start time point of a photoconductor driving unit based on a ready time of an intermediate transfer unit and a ready time of a photoconductor driving unit, in the image forming apparatus according to an exemplary embodiment.

FIG. 7 is a view for explaining a process of determining an operation time point of a photoconductor driving unit 240 based on a ready time of the intermediate transfer unit 330 and a ready time of the photoconductor driving unit 240, in the image forming apparatus 10 according to an exemplary embodiment.

Referring to FIG. 7, first to fourth signal tables indicating starts or completion of processes are shown. From the top, the first signal table shows a time point at which the intermediate transfer unit 330 forms a primary transfer region together with a photoconductor 210, the second signal table shows an operation start time point of the photoconductor driving unit 240, the third signal table shows a time point at which the photoconductor driving unit 240 enters a constant-speed rotation state, and the fourth signal table shows a time point after the photoconductor driving unit 240 enters a constant-speed rotation state, a ready time for preparing an electrostatic latent image is terminated, and the intermediate transfer unit 330 forms a primary transfer region together with the photoconductor 210.

In the first signal table, a time period predicted to be necessary for the intermediate transfer unit 330 to form a primary transfer region together with the photoconductor 210 is a ready time [I] of the intermediate transfer unit 330.

A time period from a signal generation time point of the second signal table to a signal generation time point of the third signal table is a ready time [A] of the photoconductor driving unit 240 predicted to be necessary to enter a constant-speed rotation state.

A time period from a signal generation time point of the third signal table to a signal generation time point of the fourth signal table is a time period [B] necessary to prepare forming of an electrostatic latent image after the photoconductor driving unit 240 enters a constant-speed rotation state. A signal generation time point of the fourth signal table is a time point at which a synchronizing signal PSYNC is generated when the intermediate transfer unit 330 forms a primary transfer region together with the photoconductor 210.

If the photoconductor driving unit 240 enters a constant-speed rotation state and the ready time [B] necessary to prepare forming of an electrostatic latent image is terminated within the ready time [I] of the intermediate transfer unit 330 predicted to be necessary to form a primary transfer region together with the photoconductor 210, the photoconductor 210 may wear down. Therefore, an optimal condition may be that the ready time [I] of the intermediate transfer unit 330 is terminated together with the ready time [B] necessary to prepare forming of an electrostatic latent image after the ready time [A] of the photoconductor driving unit 240 predicted to be necessary to enter a constant-speed rotation state. If the optimal condition is satisfied, a delay or unnecessary idling of the photoconductor 210 may be prevented during image forming processes.

To satisfy the optimal condition, the control unit 11 of the image forming apparatus 10 may determine an operation start time point of the photoconductor driving unit 240 by inversely calculating the ready time [B] necessary to prepare forming of an electrostatic latent image after the photoconductor driving unit 240 enters a constant-speed rotation state, and the ready time [A] of the photoconductor driving unit 240, from the ready time [I] of the intermediate transfer unit 330 predicted to be necessary to form a primary transfer region together with the photoconductor 210.

As shown in FIG. 7, an operation start time point [I] (hereinafter referred to as a fourth operation start time point [I']) of the photoconductor driving unit 240 may be expressed by Equation 4 based on the ready time [I] of the intermediate transfer unit 330, the ready time [A] of the photoconductor driving unit 240, and the ready time [B] necessary to prepare forming of an electrostatic latent image after the photoconductor driving unit 240 enters a constant-speed rotation state.

$$[I']=[I]-[A]-[B] \quad \text{[Equation 4]}$$

At this time, the ready time [I] of the intermediate transfer unit 330 may previously be stored in the storage 14 of the image forming apparatus 10. The ready time [A] of the photoconductor driving unit 240 may be predicted based on a time period during which the photoconductor driving unit 240 is left without rotation and the internal temperature of the image forming apparatus 10, and may previously be stored in the storage 14 of the image forming apparatus 10. In addition, the ready time [B] necessary to prepare forming of an electrostatic latent image after the photoconductor driving unit 240 enters a constant-speed rotation state may previously be stored in the storage 14 of the image forming apparatus 10.

If the photoconductor driving unit 240 starts to operate at the fourth operation start time point [I] in consideration of the operation of the intermediate transfer unit 330, a delay or unnecessary idling of the photoconductor 210 may be minimized during image forming processes.

Figure 8:
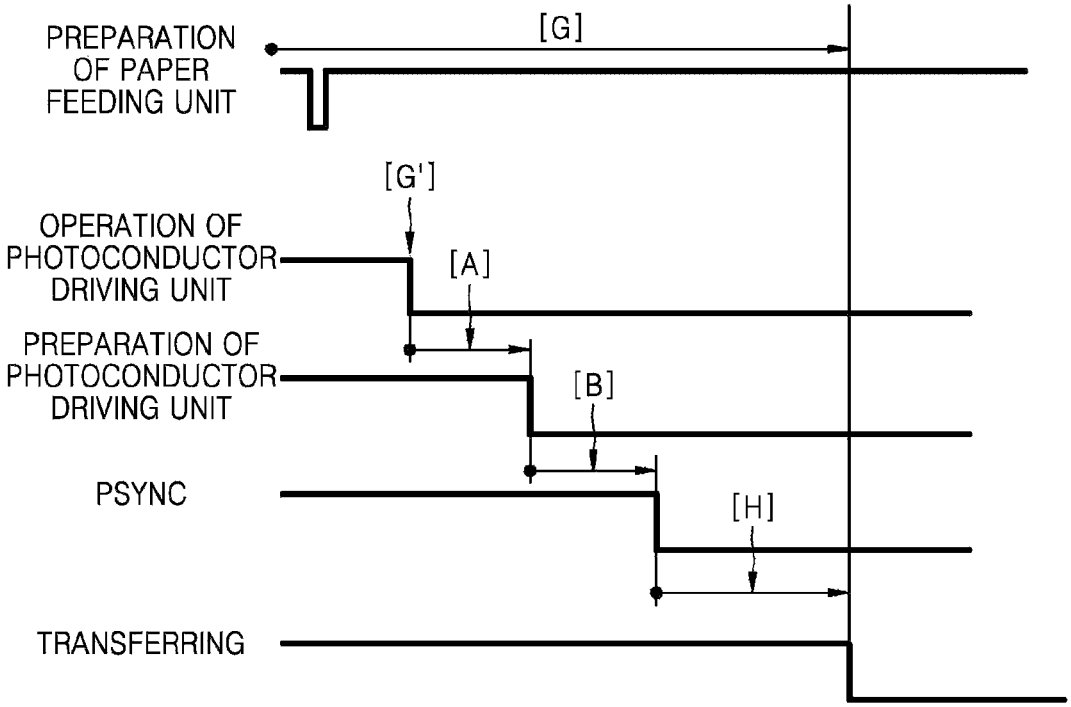
FIG. 8 is a view for explaining a process of determining an operation start time point of a photoconductor driving unit based on a ready time of a paper feeding unit and a ready time of the photoconductor driving unit, in the image forming apparatus according to an exemplary embodiment.

FIG. 8 is a view for explaining a process of determining an operation time point of a photoconductor driving unit 240 based on a ready time of the paper feeding unit 500 and a ready time of the photoconductor driving unit 240, in the image forming apparatus 10 according to an exemplary embodiment.

Referring to FIG. 8, first to fifth signal tables indicating starts or completion of processes are shown. From the top, the first signal table shows a time period predicted to be necessary for the paper feeding unit 500 to feed paper to which a toner image will be transferred by using the pickup roller 510 and the feeding rollers 520, the second signal table shows an operation start time point of the photoconductor driving unit 240, the third signal table shows a time point at which the photoconductor driving unit 240 enters a constant-speed rotation state, the fourth signal table shows a ready time necessary to prepare forming of an electrostatic latent image after the photoconductor driving unit 240 enters a constant-speed rotation state, and the fifth signal table shows a time point at which transferring starts.

In the first signal table, the time period predicted to be necessary for the paper feeding unit 500 to feed paper to which a toner image will be transferred by using the pickup roller 510 and the feeding rollers 520 is a ready time [G] of the paper feeding unit 500.

A time period from a signal generation time point of the second signal table to a signal generation time point of the third signal table is a ready time [A] of the photoconductor driving unit 240 predicted to be necessary to enter a constant-speed rotation state.

A time period from a signal generation time point of the third signal table to a signal generation time point of the fourth signal table is a ready time [B] necessary to prepare forming of an electrostatic latent image after the photoconductor driving unit 240 enters a constant-speed rotation state.

A time period from a signal generation time point of the fourth signal table to a signal generation time point of the fifth signal table is a time [H] predicted to be necessary for a photoconductor 210 to move from an exposure position to a transfer position. The signal generation time point of the fourth signal table is a time point at which a synchronizing signal PSYNC is generated when the photoconductor 210 is ready to be exposed to light after preparation of forming of an electrostatic latent image is completed.

If the ready time [B] necessary to prepare forming of an electrostatic latent image after the photoconductor driving unit 240 enters a constant-speed rotation state and a time point at which transferring is ready are within the ready time [G] predicted to be necessary for the paper feeding unit 500 to feed paper to which a toner image will be transferred by using the pickup roller 510 and the feeding rollers 520, the photoconductor 210 may wear down. Therefore, an optimal condition may be that the ready time [G] of the paper feeding unit 500 is terminated together with the ready time [A] of the photoconductor driving unit 240 predicted to be necessary to enter a constant-speed rotation state, the ready time [B] necessary to prepare forming of an electrostatic latent image after the photoconductor driving unit 240 enters a constant-speed rotation state, and the time [H] predicted to be necessary for the photoconductor 210 to move from an exposure position to a transfer position. If the optimal condition is satisfied, a delay or unnecessary idling of the photoconductor 210 may be prevented during image forming processes.

To satisfy the optimal condition, the control unit 11 of the image forming apparatus 10 may determine an operation start time point of the photoconductor driving unit 240 by inversely calculating the time [H] predicted to be necessary for the photoconductor 210 to move from an exposure position to a transfer position, the ready time [B] necessary to prepare forming of an electrostatic latent image after the photoconductor driving unit 240 enters a constant-speed rotation state, and the ready time [A] of the photoconductor driving unit 240, from the ready time [G] of the paper feeding unit 500 predicted to be necessary to feed paper to which a toner image will be transferred by using the pickup roller 510 and the feeding rollers 520.

As shown in FIG. 8, an operation start time point [G'] (hereinafter referred to as a fifth operation start time point [G']) of the photoconductor driving unit 240 may be expressed by Equation 5 based on the ready time [G] of the paper feeding unit 500, the ready time [A] of the photoconductor driving unit 240, the ready time [B] necessary to prepare forming of an electrostatic latent image after the photoconductor driving unit 240 enters a constant-speed rotation state, and the time [H] predicted to be necessary for the photoconductor 210 to move from an exposure position to a transfer position.

$$[G']=[G]-[A]-[B]-[H] \quad \text{[Equation 5]}$$

The ready time [G] of the paper feeding unit 500 may be predicted based on the position of the tray 600*a* or 600*b* supplying paper, and may previously be stored in the storage 14 of the image forming apparatus 10. The ready time [A] of the photoconductor driving unit 240 may be predicted based on a time period during which the photoconductor driving unit 240 is left without rotation and the internal temperature of the image forming apparatus 10, and may previously be stored in the storage 14 of the image forming apparatus 10. In addition, the ready time [B] necessary to prepare forming of an electrostatic latent image after the photoconductor driving unit 240 enters a constant-speed rotation state, and the time [H] predicted to be necessary for the photoconductor 210 to move from an exposure position to a transfer position may previously be stored in the storage 14 of the image forming apparatus 10.

If the photoconductor driving unit 240 starts to operate at the fifth operation start time point [G'] in consideration of the operation of the paper feeding unit 500, a delay or unnecessary idling of the photoconductor 210 may be minimized during image forming processes.

Figure 9:
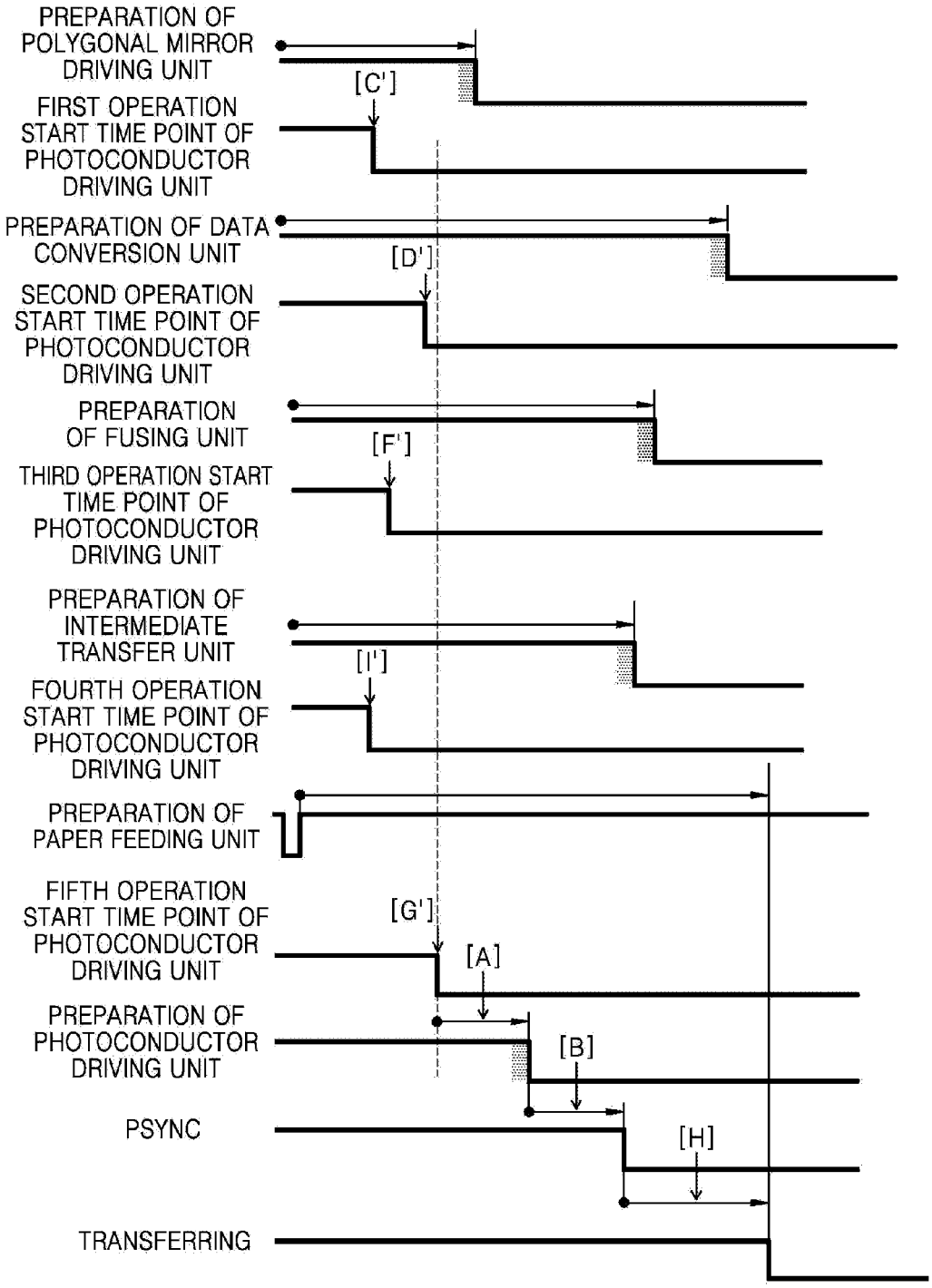
FIG. 9 is a view for explaining a process of determining an operation start time point of a photoconductor driving unit based on ready times of a plurality of devices used in image forming processes and a ready time of the photoconductor driving unit, in the image forming apparatus according to an exemplary embodiment.

FIG. 9 is a view for explaining a process of determining an operation time point of a photoconductor driving unit 240 based on ready times of a plurality of devices used in image forming processes and a ready time of the photoconductor driving unit 240 in the image forming apparatus 10 according to an exemplary embodiment.

In the current embodiment, the control unit 11 of the image forming apparatus 10 may determine a plurality of operation start time points of the photoconductor driving unit 240 based on the ready time of the photoconductor driving unit 240 and ready times of a plurality of devices used in image forming processes, and may determine the latest one of the plurality of operation time points as the operation time point of the photoconductor driving unit 240.

For example, two operation start time points of the photoconductor driving unit 240 may be determined based on at least two of the light scanning unit 100, the data conversion unit 140 converting image data into exposure data available to the light scanning unit 100, the intermediate transfer unit 330 receiving a toner image from the photoconductor 210, the fusing unit 400, and the paper feeding unit 500, and the later of the two operation start time points may be determined as the operation start time point of the photoconductor driving unit 240.

Referring to an example shown in FIG. 9, the first operation start time point [C'], the second operation start time point [D'], the third operation start time point [F'], the fourth operation start time point [I], and the fifth operation start time point [G'] of the photoconductor driving unit 240 explained with reference to FIGS. 4 to 8 are shown together. If an operation start time point of the photoconductor driving unit 240 is determined based on the light scanning unit 100, the data conversion unit 140, the intermediate transfer unit 330, the fusing unit 400, and the paper feeding unit 500, the fifth operation start time point [G'] which is latest may be determined as the operation start time point of the photoconductor driving unit 240 for preventing a delay or unnecessary idling of the photoconductor 210 during image forming processes.

FIG. 10 is a view illustrating ready times [A] of a photoconductor driving unit 240 stored in the storage 14 of the image forming apparatus 10 according to an exemplary embodiment.

The ready times [A] of the photoconductor driving unit 240 may be predicted based on time periods during which the photoconductor driving unit 240 is left without rotation and internal temperatures of the image forming apparatus 10, and may previously be stored in the storage 14 of the image forming apparatus 10.

FIG. 11 is a view illustrating ready times [C] of a polygonal mirror driving unit 120 of a light scanning unit 100 stored in the storage 14 of the image forming apparatus 10 according to an exemplary embodiment.

The ready times [C] of the light scanning unit 100 or the ready time [C] of the polygonal mirror driving unit 120 may be predicted based on time periods during which the light scanning unit 100 is left without light emission and internal temperatures of the image forming apparatus 10, and may previously be stored in the storage 14 of the image forming apparatus 10.

FIG. 12 is a view illustrating ready times [D] of a data conversion unit 140 stored in the storage 14 of the image forming apparatus 10 according to an exemplary embodiment.

The ready times [D] of the data conversion unit 140 may be predicted based on paper sizes, image types, and image quality levels, and may previously be stored in the storage 14 of the image forming apparatus 10.

Figures 13, 14, 15:
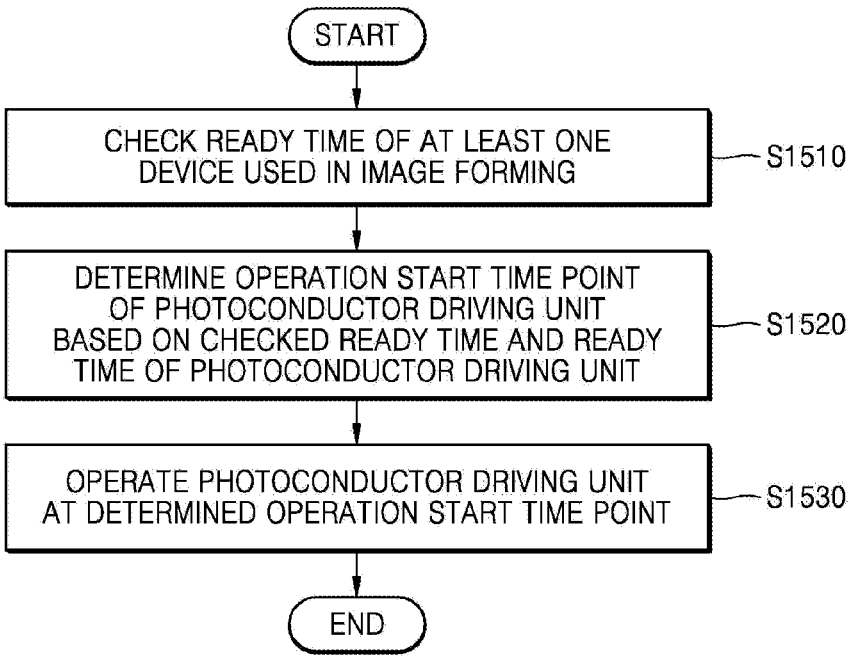
FIG. 13 is a view illustrating ready times of the intermediate transfer unit stored in a storage in the image forming apparatus according to an exemplary embodiment.
FIG. 14 is a view illustrating ready times of the paper feeding unit stored in the storage in the image forming apparatus according to an exemplary embodiment.
FIG. 15 is a flowchart for explaining a method of controlling an image forming apparatus according to an exemplary embodiment.

FIG. 13 is a view illustrating ready times [I] of the intermediate transfer unit 330 stored in the storage 14 of the image forming apparatus 10 according to an exemplary embodiment.

The ready times [I] of the intermediate transfer unit 330 may previously be stored in the storage 14 of the image forming apparatus 10 in the form of a table as shown in FIG. 13.

FIG. 14 is a view illustrating ready times [G] of the paper feeding unit 500 stored in the storage 14 of the image forming apparatus 10 according to an exemplary embodiment.

The ready times [G] of the paper feeding unit 500 may be predicted based on the positions of the trays 600*a* and 600*b* supplying paper, and may previously be stored in the storage 14 of the image forming apparatus 10.

FIG. 15 is a flowchart for explaining a method of controlling the image forming apparatus 10 according to an exemplary embodiment. Although not described in the following description, the above-described structures and operations of the image forming apparatus 10 may also be applied to the method of controlling the image forming apparatus 10.

First, in operation S1510, the image forming apparatus 10 checks a ready time of at least one device used in image forming.

In operation S1520, the image forming apparatus 10 determines an operation start time point of a photoconductor driving unit 240 based on the checked ready time of the at least one device and a ready time of the photoconductor driving unit 240 predicted to be necessary to enter a constant-speed rotation state.

For example, if the at least one device is a light scanning unit 100, the image forming apparatus 10 may determine the operation start time point of the photoconductor driving unit 240 by inversely calculating the ready time of the photoconductor driving unit 240 from a ready time of the light scanning unit 100 predicted to be necessary to prepare emitting light.

In another example, if the at least one device is a data conversion unit 140 converting image data into exposure data available to a light scanning unit 100, the image forming apparatus 10 may determine the operation start time point of the photoconductor driving unit 240 by inversely calculating a ready time necessary to prepare forming of an electrostatic latent image after the photoconductor driving unit 240 enters a constant-speed rotation state, and the ready time of the photoconductor driving unit 240, from a ready time of the data conversion unit 140 predicted to be necessary to complete conversion of image data.

In another example, if the at least one device is the fusing unit 400, the image forming apparatus 10 may determine the operation start time point of the photoconductor driving unit 240 by inversely calculating the ready time necessary to prepare forming of an electrostatic latent image after the photoconductor driving unit 240 enters a constant-speed rotation state, and the ready time of the photoconductor driving unit 240, from a ready time of the fusing unit 400 predicted to be necessary to enter a state capable of fusing a toner image transferred to paper.

In another example, if the at least one device is the intermediate transfer unit 330 receiving a toner image from the photoconductor 210, the image forming apparatus 10 may determine the operation start time point of the photoconductor driving unit 240 by inversely calculating the ready time necessary to prepare forming of an electrostatic latent image after the photoconductor driving unit 240 enters a constant-speed rotation state, and the ready time of the photoconductor driving unit 240, from a ready time of the intermediate transfer unit 330 predicted to be necessary to form a primary transfer region together with the photoconductor 210.

In another example, if the at least one device is the paper feeding unit 500, the image forming apparatus 10 may determine the operation start time point of the photoconductor driving unit 240 by inversely calculating a time predicted to be necessary for the photoconductor 210 to move from an exposure position to a transfer position, the ready time necessary to prepare forming of an electrostatic latent image after the photoconductor driving unit 240 enters a constant-speed rotation state, and the ready time of the photoconductor driving unit 240, from a ready time of the paper feeding unit 500 predicted to be necessary to feed paper to which a toner image will be transferred by using the pickup roller 510 and the feeding rollers 520.

In another example, the image forming apparatus 10 may determine the operation start time point of the photoconductor driving unit 240 in consideration of a plurality of devices used in image forming, as following: the image forming apparatus 10 determines a plurality of operation start time points of the photoconductor driving unit 240 based on ready times of the plurality of devices used in image forming and the ready time of the photoconductor driving unit 240, and may determine the latest one of the plurality of operation time points as the operation time point of the photoconductor driving unit 240. At this time, the plurality of devices may be at least two of the light scanning units 100, the data conversion units 140, the intermediate transfer unit 330, the fusing unit 400, and the paper feeding unit 500.

In operation S1530, the image forming apparatus 10 operates the photoconductor driving unit 240 at the determined operation start time point.

As described above, according to the one or more of the above-described exemplary embodiments, unnecessary idling of the photoconductor may be minimized to increase the lifespan of the image forming apparatus.

In addition, other exemplary embodiments can also be implemented through computer readable code/instructions in/on a non-transitory medium, e.g., a non-transitory computer readable medium, to control at least one processing element to implement any embodiment. A non-transitory medium can correspond to any non-transitory medium/media permitting the storage of the computer readable code/instructions.

Processes, functions, methods, and/or software in apparatuses described herein may be recorded, stored, or fixed in one or more non-transitory computer-readable media (computer readable storage (recording) media) that includes program instructions (computer readable instructions) to be implemented by a computer to cause one or more processors to execute (perform or implement) the program instructions. The media may also include, alone or in combination with the program instructions, data files, data structures, and the like. The media and program instructions may be those specially designed and constructed, or they may be of the kind well-known and available to those having skill in the computer software arts. Examples of non-transitory computer-readable media include magnetic media, such as hard disks, floppy disks, and magnetic tape; optical media such as CD ROM disks and DVDs; magneto-optical media, such as optical disks; and hardware devices that are specially configured to store and perform program instructions, such as read-only memory (ROM), random access memory (RAM), flash memory, and the like. Examples of program instructions include machine code, such as produced by a compiler, and files containing higher level code that may be executed by the computer using an interpreter. The program instructions may be executed by one or more processors. The described hardware devices may be configured to act as one or more software modules that are recorded, stored, or fixed in one or more non-transitory computer-readable media, in order to perform the operations and methods described above, or vice versa. In addition, a non-transitory computer-readable medium may be distributed among computer systems connected through a network and program instructions may be stored and executed in a decentralized manner. In addition, the computer-readable media may also be embodied in at least one application specific integrated circuit (ASIC) or Field Programmable Gate Array (FPGA).

It should be understood that exemplary embodiments described above should be considered in a descriptive sense only and not for purposes of limitation. Descriptions of features or aspects within each embodiment should typically be considered as available for other similar features or aspects in other embodiments.

While one or more exemplary embodiments have been described with reference to the figures, it will be understood by those of ordinary skill in the art that various changes in form and details may be made therein without departing from the spirit and scope of the present disclosure as defined by the following claims and their equivalents.

What is claimed is:

1. An electrophotographic image forming apparatus comprising:

a storage to store a ready time of at least one device used in an image forming process;

a control unit to determine an operation start time point of a photoconductor driving unit based on the ready time of the at least one device stored in the storage and a ready time of the photoconductor driving unit predicted to be necessary to enter a constant-speed rotation state; and an image forming unit to form an image by operating the photoconductor driving unit at the determined operation start time point.

2. The image forming apparatus of claim 1, wherein:

the at least one device is a data conversion unit which converts image data into exposure data available to a light scanning unit, and the ready time of the at least one device is a ready time of the data conversion unit, and the control unit determines the operation start time point of the photoconductor driving unit by inversely calculating a ready time necessary to prepare forming of an electrostatic latent image after the photoconductor driving unit enters a constant-speed rotation state, and the ready time of the photoconductor driving unit, from the ready time of the data conversion unit predicted to be necessary to complete conversion of the image data.

3. The image forming apparatus of claim 2, wherein the ready time of the data conversion unit is predicted based on a paper size, an image type, and an image quality level.

4. The image forming apparatus of claim 1, wherein:

the at least one device is a fusing unit and the ready time of the at least one device is a ready time of the fusing unit, and the control unit determines the operation start time point of the photoconductor driving unit by inversely calculating a ready time necessary to prepare forming of an electrostatic latent image after the photoconductor driving unit enters a constant-speed rotation state, and the ready time of the photoconductor driving unit, from the ready time of the fusing unit predicted to be necessary to enter a state capable of fusing a toner image transferred to paper.

5. The image forming apparatus of claim 1, wherein:

the at least one device is an intermediate transfer unit which receives a toner image from a photoconductor, and the ready time of the at least one device is a ready time of the intermediate transfer unit, and the control unit determines the operation start time point of the photoconductor driving unit by inversely calculating a ready time necessary to prepare forming an electrostatic latent image after the photoconductor driving unit enters a constant-speed rotation state, and the ready time of the photoconductor driving unit, from the ready time of the intermediate transfer unit predicted to be necessary to form a primary transfer region together with the photoconductor.

6. The image forming apparatus of claim 1, wherein:

the at least one device is a paper feeding unit, and the ready time of the at least one device is a ready time of the paper feeding unit, and the control unit determines the operation start time point of the photoconductor driving unit by inversely calculating a time of the photoconductor predicted to be necessary to rotate from an exposure position to a transfer position, a ready time necessary to prepare forming of an electrostatic latent image after the photoconductor driving unit enters a constant-speed rotation state, and the ready time of the photoconductor driving unit, from the ready time of the paper feeding unit predicted to be necessary to feed paper to which a toner image will be transferred by using a pickup roller and a feeding roller.

7. The image forming apparatus of claim 1, wherein the ready time of the photoconductor driving unit is predicted based on a time during which the photoconductor driving unit is left without rotation and an internal temperature of the image forming apparatus.

8. The image forming apparatus of claim 1, wherein the control unit determines a plurality of operation start time points of the photoconductor driving unit based on the ready time of the photoconductor driving unit and ready times of a plurality of devices used in image forming processes, and the control unit determines the latest one of the plurality of operation start time points as the operation start time point of the photoconductor driving unit.

9. The image forming apparatus of claim 8, wherein the plurality of devices comprise at least two of a light scanning unit, a data conversion unit to convert image data into exposure data available to the light scanning unit, an intermediate transfer unit to receive a toner image from a photoconductor, a fusing unit, and a paper feeding unit.

10. A method of controlling an electrophotographic image forming apparatus, the method comprising:

checking a ready time of at least one device used in an image forming process;

determining an operation start time point of a photoconductor driving unit based on the ready time of the at least one device and a ready time of the photoconductor driving unit predicted to be necessary to enter a constant-speed rotation state; and operating the photoconductor driving unit at the determined operation start time point.

11. The method of claim 10, wherein:

the at least one device is a data conversion unit which converts image data into exposure data available to a light scanning unit, and the ready time of the at least one device is a ready time of the data conversion unit, and in the determining of the operation start time point, the operation start time point of the photoconductor driving unit is determined by inversely calculating a ready time necessary to prepare forming of an electrostatic latent image after the photoconductor driving unit enters a constant-speed rotation state, and the ready time of the photoconductor driving unit, from the ready time of the data conversion unit predicted to be necessary to complete conversion of the image data.

12. The method of claim 11, wherein the ready time of the data conversion unit is predicted based on a paper size, an image type, and an image quality level.

13. The method of claim 10, wherein:

the at least one device is a fusing unit, and the ready time of the at least one device is a ready time of the fusing unit, and in the determining of the operation start time point, the operation start time point of the photoconductor driving unit is determined by inversely calculating a ready time necessary to prepare forming of an electrostatic latent image after the photoconductor driving unit enters a constant-speed rotation state, and the ready time of the photoconductor driving unit, from the ready time of the fusing unit predicted to be necessary to enter a state capable of fusing a toner image transferred to paper.

14. The method of claim 10, wherein:

the at least one device is an intermediate transfer unit receiving a toner image from a photoconductor, and the ready time of the at least one device is a ready time of the intermediate transfer unit, and in the determining of the operation start time point, the operation start time point of the photoconductor driving unit is determined by inversely calculating a ready time necessary to prepare forming of an electrostatic latent image after the photoconductor driving unit enters a constant-speed rotation state, and the ready time of the photoconductor driving unit, from the ready time of the intermediate transfer unit predicted to be necessary to form a primary transfer region together with the photoconductor.

15. The method of claim 10, wherein:

the at least one device is a paper feeding unit, and the ready time of the at least one device is a ready time of the paper feeding unit, and in the determining of the operation start time point, the operation start time point of the photoconductor driving unit is determined by inversely calculating a time of the photoconductor predicted to be necessary to rotate from an exposure position to a transfer position, a ready time necessary to prepare forming of an electrostatic latent image after the photoconductor driving unit enters a constant-speed rotation state, and the ready time of the photoconductor driving unit, from the ready time of the paper feeding unit predicted to be necessary to feed paper to which a toner image will be transferred by using a pickup roller and a feeding roller.

16. The method of claim 10, wherein the ready time of the photoconductor driving unit is predicted based on a time during which the photoconductor driving unit is left without rotation and an internal temperature of the image forming apparatus.

17. The method of claim 10, wherein the determining of the operation start time point comprises:

determining a plurality of operation start time points of the photoconductor driving unit based on the ready time of the photoconductor driving unit and ready times of a plurality of devices used in image forming processes; and determining the latest one of the plurality of operation start time points as the operation start time point of the photoconductor driving unit.

18. The method of claim 17, wherein the plurality of devices comprise at least two of a light scanning unit, a data conversion unit to convert image data into exposure data available to the light scanning unit, an intermediate transfer unit to receive a toner image from a photoconductor, a fusing unit, and a paper feeding unit.

19. At least one non-transitory computer readable medium storing computer readable instructions which when executed control at least one processor to implement a method of claim 10.

* * * * *